US005085110A

United States Patent [19]

Scholtysik et al.

[11] Patent Number: 5,085,110

[45] Date of Patent: Feb. 4, 1992

[54] CUTTING DEVICE FOR THE LONGITUDINAL CUTTING OF FOIL LENGTHS

[75] Inventors: Bernd Scholtysik, Munich; Josef Birkmann, Fuerstenfeldbruck, both of Fed. Rep. of Germany

[73] Assignee: Agfa-Gevaert Agktiengesellschaft, Leverkusen, Fed. Rep. of Germany

[21] Appl. No.: 520,766

[22] Filed: May 8, 1990

Related U.S. Application Data

[60] Division of Ser. No. 317,049, Feb. 27, 1989, abandoned, which is a continuation of Ser. No. 142,452, Jan. 11, 1988, abandoned.

[30] Foreign Application Priority Data

Jan. 22, 1987 [DE] Fed. Rep. of Germany ..... 3701716

[51] Int. Cl.[5] ..... B26D 1/24

[52] U.S. Cl. ..... 83/34; 83/39; 83/501; 83/676; 83/955; 76/85

[58] Field of Search ..... 83/501, 502, 503, 425.2, 83/425.3, 425.4, 664, 665, 676, 481, 34, 39, 955; 29/89.5, 557, 404; 76/85

[56] References Cited

U.S. PATENT DOCUMENTS

| | | | |
|---|---|---|---|
| 164,920 | 6/1875 | Judson | 83/501 |
| 1,673,336 | 6/1928 | Lehmicke | 83/501 |
| 2,006,106 | 6/1935 | Markert | 83/501 |
| 3,185,010 | 5/1965 | Printz et al. | 83/501 |
| 3,286,574 | 11/1966 | Durand | 83/501 |
| 3,894,461 | 7/1975 | Jakob | 83/481 |
| 3,977,285 | 8/1976 | Perztsch et al. | 83/676 |
| 4,330,092 | 5/1982 | Roman | 83/501 |

FOREIGN PATENT DOCUMENTS

| | | | |
|---|---|---|---|
| 76978 | 6/1919 | Austria | 83/501 |
| 305586 | 12/1917 | Fed. Rep. of Germany | 83/501 |
| 51-75816 | 1/1978 | Japan | 83/500 |
| 454623 | 9/1936 | United Kingdom | 83/501 |

*Primary Examiner*—Hien H. Phan
*Assistant Examiner*—Scott A. Smith
*Attorney, Agent, or Firm*—Connolly & Hutz

[57] ABSTRACT

A cutting device for layered or unlayered foil lengths, having good cut quality and an extended period of use before re-grinding of the cutter is required, consists of cylindrically shaped keyway cutter bars with distance rings lying between them, which are mounted on a blade shaft, and of roller blades of right-angles cross-section, which are equally mounted on a blade shaft and wherein each roller blade is pressed by a spring washer against the corresponding keyway cutter bar. The advantage according to the invention consists in that first each roller blade is supported on one of the cutting blades of the keyway cutter bar and that after these cutting shoulders wear off the whole roller blade shaft is turned around and in each case the other cutting shoulder is used for cutting. After these cutting shoulders too have worn off the cutting device is made usuable for further cutting operation by grinding off the cylindrical outer surface of the keyway cutter bars (FIG. 2).

6 Claims, 4 Drawing Sheets

CUTTING DEVICE FOR THE LONGITUDINAL CUTTING OF FOIL LENGTHS

This is a division of U.S. application Ser. No. 07,317,049 filed Feb. 27, 1989, now abandoned, which is a filewrapper continuation of Ser. No. 07,142,452 filed Jan. 11, 1988, now abandoned.

The invention relates to a cutting device for foil lengths or layered foil lengths such as for example magnetic tapes, consisting of several roller blades 1 rotatably mounted on a shaft 7 and a corresponding number of keyway cutterbars 3 rotatably mounted on a shaft 6, wherein the roller blades are braced by a spring against the cutting shoulder of the keyway cutterbar.

Foil lengths, in particular layered lengths for photographic and magnetisable materials, are cut longitudinally into a plethora of narrow strips during subsequent processing. Circular knife cutting is the most wide spread of longitudinal cutting processes. There, the circular top and bottom cutters arranged on suitable cutter shafts work together. An embodiment has been published in which the circular top cutter (roller blade) dips into the shoulder of a circular bottom cutter (keyway cutterbar). In the cutting of foils with abrasive layers, for example with magnetic tapes layered with ion-oxide or chrome dioxide, the cutting edges are very markedly ground off, wherein during advanced use, the roller blade digs into the keyway cutterbar. If the edge wear increases, for example of the order of the size of the foil thickness, the blades begin to cut in a crushing fashion, which results in a bad cutting quality. This is made apparent by a bending of the cutting edges, which leads to uneven tape reels during subsequent reeling of the tapes. In these cases, the cutters from the cutting devices must be exchanged and ground off again, in order to recover sharp cutting edges. The disadvantages for the rational use of the cutting device resulting from the repeated assembly and disassembly of the cutters are obvious.

An improved cutting device, yielding a significantly longer service life of the cutters, is published in U.S. Pat. No. 3,877,285. There, as may be seen from FIG. 1, a roller blade (1) pressed against the cutting shoulder (2) of a keyway cutterbar (3) by a spring washer (4), dips in to a somewhat greater depth than the thickness of the cutting shoulder. A disadvantage of this device however, consists in that, due to the advancing excavation of the cutting shoulder of the keyway cutter bar during re-grinding of the keyway cutter bar, the surface of application of the foil length to be cut becomes ever smaller, as the gap length (B) becomes ever greater, leading to a reduced quality of cut. In addition, the pressure of the spring washers must be continuously readjusted due to wear on the cutting shoulders in operation.

A cutting system is published in the IEEE-transaction on magnetics, Vol. Mag. 10, No.1, Jan. 1980, page 83, paragraph 2.13, in which the roller blades are fixed rigidly to the roller blade shaft without springy components. The pressure of the roller blade against the cutting shoulders of the keyway cutterbar results from the elastic deformation of the roller blade itself. However, this device has a grave disadvantage; due to inaccuracies in the geometry of the roller blade and keyway cutterbar, and in that of the distance plates between them, the pressure of each roller blade against the keyway cutter bar assigned to it may be different, where it must be considered that there are often more than 100 cutting elements on one blade shaft. This, as experiments with this device have shown, results in a cutting quality that varies from one strip to the next, and the blades wear out very quickly because of the high axial pressure required.

For this reason, the object consisted in finding a cutting device which does not comprise the above disadvantages and which in particular yields a long service time of roller blades and keyway cutterbars, before regrinding of the cutters is required.

The object was solved according to the invention by a cutting device in which the roller blades 1 are pressed by spring washers 4 against the cutting shoulders 10 or 11 of the keyway cutterbar 3, the dipping depth of the roller blades at the cutting shoulder of the keyway cutterbars is 0.11 mm, each keyway cutterbar 3 has on each side cutting shoulders 10, 11 and two sharp cutting edges 13, 14, wherein the cutting shoulders are ground down to a rough depth R of $<0.1$ micrometers, preferably $<0.2$ micrometers, and wherein the cylindrical curved surface 12 of the keyway cutterbar is ground down to a similarly good rough depth, and distance rings 8 are arranged between each two keyway cutterbars. Further details of the invention emerge from the sub-claim and the drawings. The invention will now be described by means of the drawings, omitting the parts not immediately relevant to the invention. In the drawings;

Figure 1:
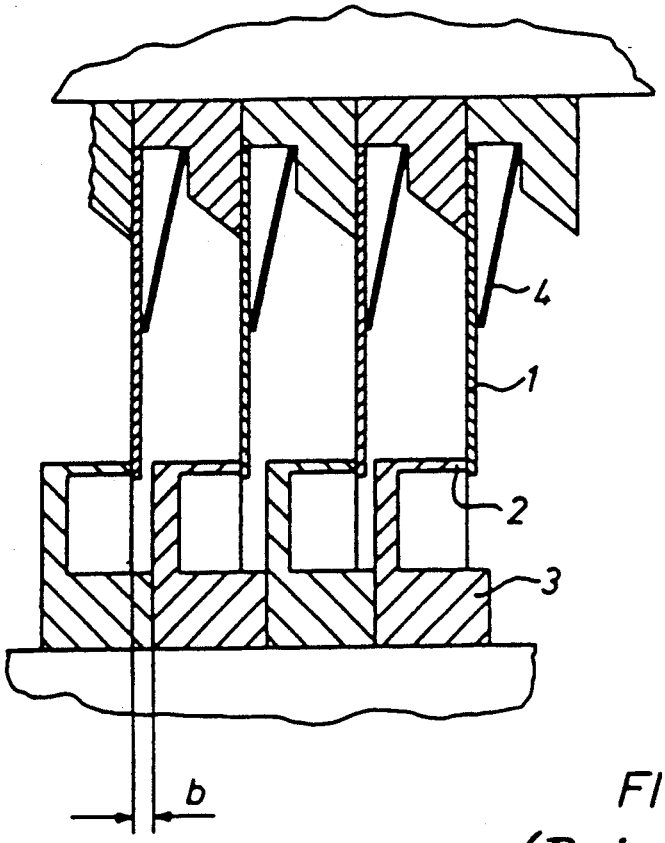
FIG. 1 (Prior Art)
FIG. 1 shows a cross-section through a cutting device according to the prior art.
Figure 2:
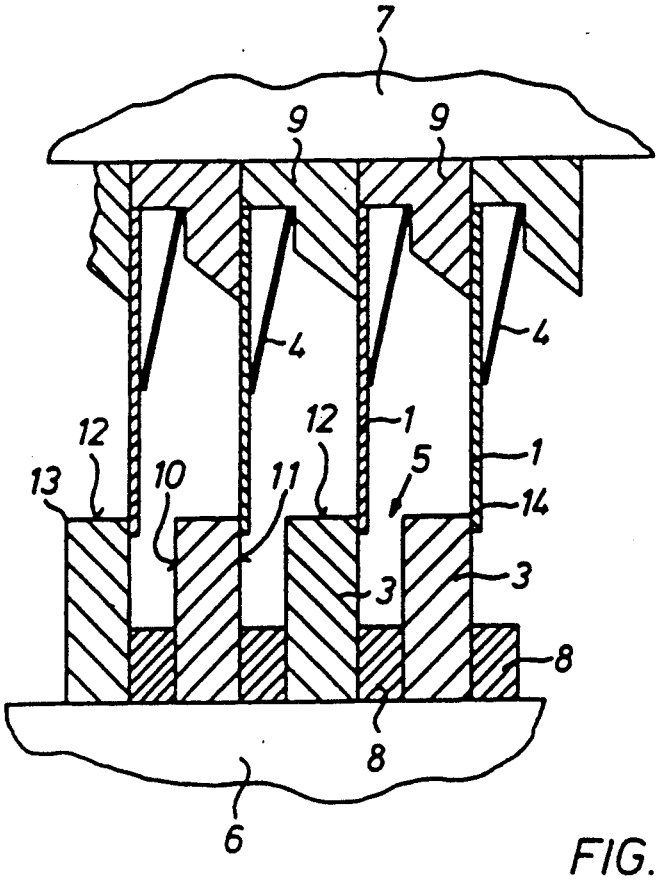
FIGS. 2 and 3 show cross-sections through a cutting device according to the present invention with a variable position of the roller blade in relation to the keyway cutterbar.

In FIG. 2, a multiply cutting tool is schematically represented, as used in the production of narrow tapes out of a wide length of foil. The roller blades (1) and the keyway cutterbars (3) are here arranged at equal distances on the blade shafts (6) or (7). The roller blades (1) dip at their circumference into a channel (5) in the keyway cutterbars, each of which are formed by the opposing surfaces of the cutting shoulders of two keyway cutterbars. The keyway cutterbars (3) are rigidly connected to the blade shaft (6). By contrast, the roller blades (1) are mounted on the upper blade shaft (7) and are braced against the division reference surface of the distance rings (9). The division separation of the distance rings (9) there corresponds to the division separation of the keyway cutterbars. Of course, the spring washers (4) can be replaced by other spring devices.

The dipping depth of the roller blades into the cutting shoulder (10,11) of the keyway cutterbars is 0.1 to 1 mm, preferably 0.3 to 0.5 mm. The roller blades can have a right-angled cross-section and a thickness of approximately 0.5 mm. Other roller blade shapes are equally possible, for example roller blades with a bevel applied on the side of the roller blade facing away from the cutting shoulder of the keyway cutterbar. The roller blade consists preferably of hard alloy, for example of the hard alloy known under the trade name Widia of the Krupp Company. The keyway cutterbars (3) can equally consist of hard alloy, otherwise of tool steel.

Figure 3:
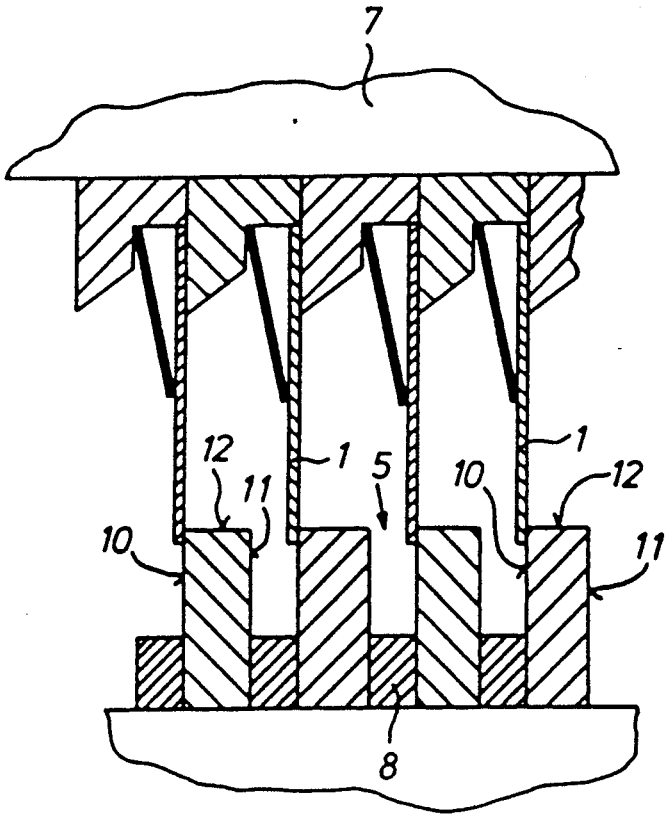

The keyway cutterbars are of right-angled cross-section in the area of contact with the roller blade and the thickness of the distance rings (8) between two keyway cutterbars is determined by the width of the tapes to be cut. For example, the thickness of the keyway cutterbars and the distance rings for separating into 3.81 mm wide magnetic tapes is approximately 2 mm each. In the production of the keyway cutterbars (3), both cutting shoulders (10,11) of the keyway cutterbars are ground down to a rough depth of $R_t < 0.2$ micrometers, preferably 0.1 micrometers. The cylindrical surface area of the keyway cutterbars is equally ground down at each subsequent grinding of the keyway cutterbars to a rough depth of less than 0.2 micrometers, wherein two sharp cutting edges (13,14) emerge on each keyway cutterbar. After the assembly of the blade shafts described above (6,7), each roller blade lies according to FIG. 2 against the right cutting shoulder (11) of the keyway cutterbar (3). During the cutting operation both blade shafts rotate in opposite senses. If, during extended operating duration, the quality of cut has become insufficient due to wear on the right cutting shoulder, then the left cutting shoulder (10), still intact, of the keyway cutterbar is used, as is represented in FIG. 3. This can occur for example, by removing and reversing the complete roller blade shaft (7). However, this is only of use if the wear on the roller blade (1) is still low. Otherwise, a roller blade shaft provided with newly ground roller blades in the manner represented in FIG. 3 is to be brought into contact with the cutting shoulder (10), unground until now, of the keyway cutter bars. Afterwards, cutting may continue until the left cutting shoulders (10) have also become unusable through wear. Only then is the keyway cutterbar shaft disassembled, and the cylindrical surface areas (12) of the keyway cutterbars are ground off, until there are sharp cutting shoulders again on each keyway cutterbar, which allow the double use of the keyway cutterbar shaft described.

The cutting system according to the invention has the following advantages compared with known cutting devices;

two sharp edges, which maybe used one after the other, develop simultaneously during the grinding process on the keyway cutterbars according to the cutting device according to the invention. Thereby, lower cutting costs in relation to the service life of the blades result, which is important for rational production.

the width of the separation rings (8) is determined by the width of slit (5) of the keyway cutterbars relevant to the cut quality of the material to be cut. This width of slit remains constant throughout the whole period of use of the cutting device according to the invention.

Due to the constant contact pressure by means of spring washers of the roller blades against the keyway cutterbars, a constant cut quality of the cut tapes results over the whole width of the foil length.

Figure 4:
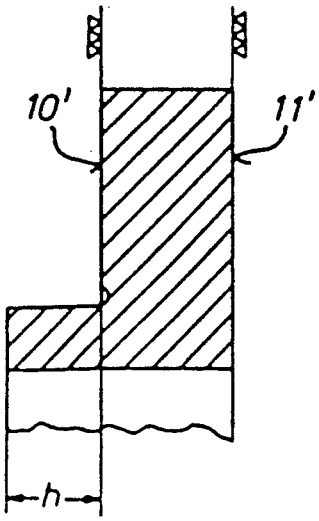
FIG. 4 shows a cross-section through another embodiment of a keyway cutterbar.

Variants of the cutting device according to the invention are also conceivable. For example, the keyway cutter bar can be of the shape represented in FIG. 4, wherein this case no distance rings are necessary, but rather the segment (h) determines the width of slit. The difference between the shape of keyway cutterbar represented in FIG. 4 from other, similar keyway cutterbars consists in that here two side surfaces (10',11') of high surface quality are present, so that in re-grinding two sharp cutting edges of the keyway cutter bars again result, allowing the double use of the keyway cutterbar shaft.

Figure 5:
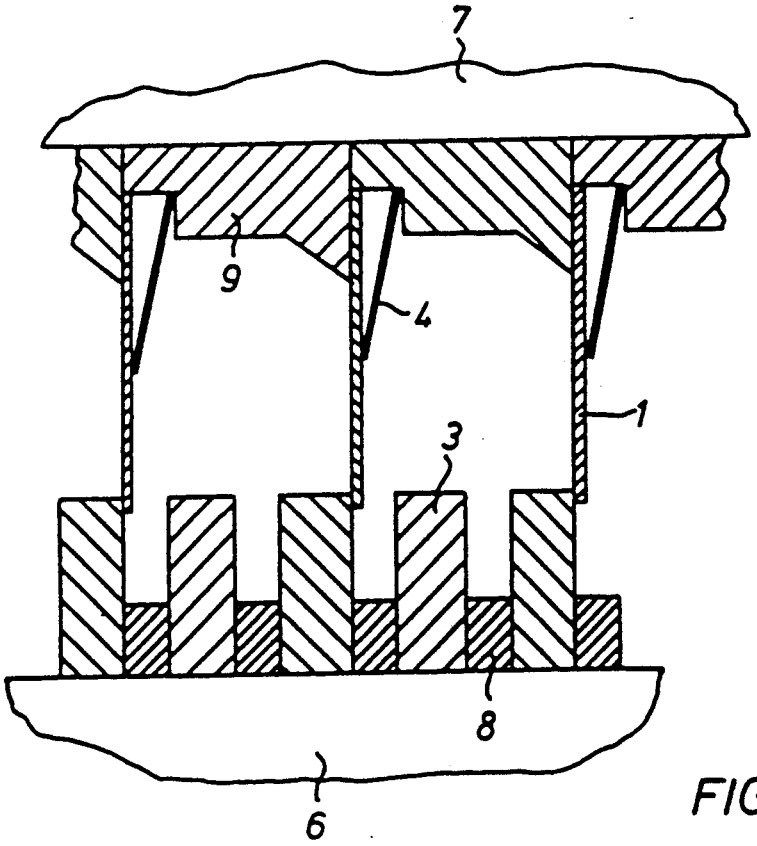
FIG. 5 shows a cross-section through a cutting device according to FIG. 2 with a changed arrangement of the circular blade shaft.

Normally the sum of keyway cutterbar and distance ring widths will determine the width of the cut tape strip. Yet integral multiples of this tapes strip width can also be obtained for the width of cut if the roller blade shaft is correspondingly equipped. FIG. 5 shows an example of this, where the strip width corresponds here to two divisions of the keyway cutter bar shaft. In this case, each strip to be cut is supported on two surfaces of the keyway cutterbars. In the example shown in FIG. 5, the keyway cutterbar shaft can be used 4 times in each re-grinding, since 4 cutting shoulders of the keyway cutter bar shaft can be deployed within the distance of the tape width.

We claim:

1. The process of cutting foils carrying abrasive layers comprising the steps of forming a sharp cutting edge on each of two cutting shoulders on each of a plurality of cylindrical keyway cutterbars by a grinding down procedure on each cutting shoulder to provide a rough depth at each shoulder of less than 0.2 micrometers so that the shoulders are equally ground down, said cutterbars being rotatably mounted on a first shaft nd each cutterbar is formed with a cylindrical curved surface between the cutterbar shoulders which in axial dimension is not less than the spacing between the cutterbars on said shaft and radial walls normal to the cylindrical surfaces forming the sharp cutting edges, pressing circular roller blades against one of the cutting shoulders of respective cutterbars so as to provide one roller blade contacting each cutterbar, said blades mounted on a second shaft, first, cutting a length of layer supporting foil into a plurality of narrow strips between said contacting roller blades and a first of said cutting shoulders, of said cutterbars, then second, cutting a length of said layer supporting foil into narrow strips between said contacting roller blades and a second of said cutting shoulders of said cutterbars, and supporting said narrow strips on the cylindrical surfaces during the cutting step.

and regrinding on each cutting shoulder to reestablish a rough depth at each shoulder of less than 0.2 micrometers so that the shoulders are equally ground down, and further cutting a length of layer supporting foil into narrow strips between said roller blades and said cutting shoulders, wherein the overlap in the contact of the roller blades with the cutter bars is in the range of from 0.2 to 1 mm.

2. A process of cutting a foil carrying an abrasive layer as claimed in claim 1 wherein the abrasive layer is a magnetisable material.

3. A process of cutting a foil carrying an abrasive layer as claimed in claim 1 wherein the contact of the roller blades with the cutterbars is in the range of from 0.2 to 0.5 mm.

4. A process of cutting a foil carrying an abrasive layer as claimed in claim 1 wherein the contact of the roller blades with the cutterbars is adjustable.

5. In the process claimed in claim 1, providing roller blades and cutterbars consisting of tool steel.

6. A process of cutting foil as claimed in claim 1 wherein the axial dimension of the cylindrical surface and of distance rings which separate the cutter bars is approximately 2 mm.

* * * * *